United States Patent [19]

Stoltz et al.

[11] 4,149,753

[45] Apr. 17, 1979

[54] CUTTER BIT ASSEMBLIES

[75] Inventors: Rolf Stoltz, Bottrop; Wilhelm Stoltefuss, Kamen; Teja Rostowski, Lunen, all of Fed. Rep. of Germany

[73] Assignee: Gewerkschaft Eisenhutte Westfalia, Lunen, Fed. Rep. of Germany

[21] Appl. No.: 811,352

[22] Filed: Jun. 29, 1977

[30] Foreign Application Priority Data

Jul. 6, 1976 [DE] Fed. Rep. of Germany ..... 2630276

[51] Int. Cl.[2] ..... E21C 25/10

[52] U.S. Cl. ..... 299/91; 299/86

[58] Field of Search ..... 299/91, 92, 93, 79; 85/818; 175/410; 308/237 R, 237 A

[56] References Cited

U.S. PATENT DOCUMENTS

| | | | |
|---|---|---|---|
| 3,132,557 | 5/1964 | Bauer | 85/8.8 |
| 3,498,677 | 3/1970 | Morrow | 299/92 |
| 3,512,838 | 5/1970 | Kniff | 299/92 X |
| 3,618,683 | 11/1971 | Hughes | 299/92 X |
| 3,820,848 | 6/1974 | Kniff | 299/92 |
| 3,986,565 | 10/1976 | Atkinson | 173/80 |

*Primary Examiner*—Ernest R. Purser
*Assistant Examiner*—William F. Pate, III
*Attorney, Agent, or Firm*—Sughrue, Rothwell, Mion, Zinn and Macpeak

[57] ABSTRACT

A cutter bit for use with a cutting or winning machine has a generally cylindrical shank and a generally conical cutting head. The shank is rotatably received, in use, within a matched bore in a bit holder. The shank is formed with a reduced-diameter portion on which is rotatably mounted a bearing ring. A compressible locking ring surrounds and grips the bearing ring so that, in use, the locking ring frictionally engages the bore in the bit holder so as to restrain relative axial movement between the cutter bit and the holder.

11 Claims, 4 Drawing Figures

CUTTER BIT ASSEMBLIES

BACKGROUND TO THE INVENTION

This invention relates to a cutter bit and a cutter bit assembly for cutting or winning.

Known cutter bit assemblies have bits having a conical cutter head and a cylindrical shank which is rotatably and replaceably insertable within a cylindrical bore of a cutter bit holder, the shank being secured against axial displacement in the bore by means of an elastic securing ring arranged in a reduced-diameter part of the cutter bit shank.

German Utility Model DT-Gbm No. 1,923,922 describes a cutter bit assembly in which the shank of the cutter bit is secured in the bore of the bit holder by means of an elastic securing ring of synthetic plastics material, rubber or the like which is seated in a groove in the bit shank and which engages in an annular groove in the bore or behind a shoulder provided in the bore. The bit is, therefore, secured by a detent-type connection. In this case, it is necessary to adapt the annular groove or the shoulder in the cylindrical bore very precisely to the position of the securing ring on the bit shank, in order to ensure that when the shank is inserted into the bore the securing ring engages in the groove or behind the shoulder. In the case of deformation or soiling of the bit holder a reliable connection is not always guaranteed. Another disadvantage of this assembly is that the shank (and hence the bit) cannot rotate about its axis, by reason of the frictional engagement with the securing ring, rotatability of the cutter bit being important in order to ensure the most uniform possible wear of the bit and the self-sharpening attendant effect.

German printed publication DT-OS 2330297 and German Pat. No. DT-PS 1940577 describe a cutter bit assembly in which the bit shank is rotatably held in a bearing bush of hardened and abrasion-resistant material, the bush being in turn rotatably mounted in the bore of the holder and secured against axial withdrawal by a circlip or the like. In order to secure the bit shank in the bearing bush, a slotted spring ring of metal is provided which sits in an annular groove in the bit shank and is provided with radial pressed-out portions, dogs or the like which engage in an annular groove in the cylindrical wall of the bore of the bearing bush. Here again, the axial securing of the bit shank is effected by a detent-type connection which requires precise fitting.

U.S. Pat. No. 3,342,531 describes a cutter bit which is detachably secured in the bore of its bit holder by means of spring-loaded locking members.

The aim of the invention is to develop a cutter bit which is rotatable within its holder without the need for cutting a detent groove, for the securing element, in an accurately predetermined position in the cylindrical inner wall of the bore in the holder. Moreover, the cutter bit should be capable of easy and rapid replacement.

SUMMARY OF THE INVENTION

The present invention provides a cutter bit for use with a cutting or winning machine, the cutter bit having a generally cylindrical shank and a generally conical cutting head, the shank being rotatably received, in use, within a matched bore in a bit holder, wherein the shank is formed with a reduced-diameter portion on which is rotatably mounted a bearing ring, and wherein a compressible locking ring surrounds and grips the bearing ring whereby, in use, the locking ring frictionally engages the bore in the bit holder so as to restrain relative axial movement between the cutter bit and the holder. Since no detent groove has to be machined at an accurate position in the cylindrical wall of the bore of the associated bit holder, not only does a simplification result in the production of the bit holder, but also the difficulties and disadvantages, which arise from defects of fit or blocking of the groove by penetrating dirt etc., are avoided. A simple and cheap O-ring can constitute the locking ring, so that again cost savings are achieved. Since the locking ring is arranged on a bearing ring which is rotatably mounted on the cutter bit shank, the desired rotatability off the cutter bit is guaranteed.

Preferably, the bearing is made of metal and the locking ring is made of synthetic plastics material or rubber.

Advantageously, the outer cylindrical surface of the bearing ring is formed with an annular groove in which seats the locking ring.

The bearing ring may be retained on said reduced-diameter portion of the shank by means of a securing element, such as a circlip which is received in a groove in said reduced-diameter portion of the shank. In this case, it is preferable for the circlip to have a diameter which is less than the minimum internal diameter of the bore in the bit holder.

Alternatively, an annular groove in the shank may constitute said reduced-diameter portion, in which case no special securing element for the bearing ring is needed. In this case, however, the bearing is preferably formed in two halves.

In either case the cutter bit can be driven, with the aid of a tool, such as a fork, out of the bore in the bit holder, without first needing to remove securing element or the like arranged at the rear end of the cutter bit and lying behind the bit holder. Since generally there are accumulations of fine material in the space behind or under the bit holder, the tasks of cleaning the cutter cylinder or other tool carrier, which otherwise are necessary in the replacing of cutter bits, are unnecessary.

Advantageously, the shank is formed with a stepped portion between said reduced-diameter portion and the cutting head. Preferably, the shoulder defining said stepped portion tapers.

The invention also provide a cutter bit assembly comprising a cutter bit as defined above and a bit holder, the bit holder having a bore which matches the shank of the cutter bit.

BRIEF DESCRIPTION OF THE DRAWINGS

Two forms of cutter bit assembly, each constructed in accordance with the invention will now be described, by way of example, with reference to the accompanying drawings, in which.

DESCRIPTION OF PREFERRED EMBODIMENTS

Figure 1:
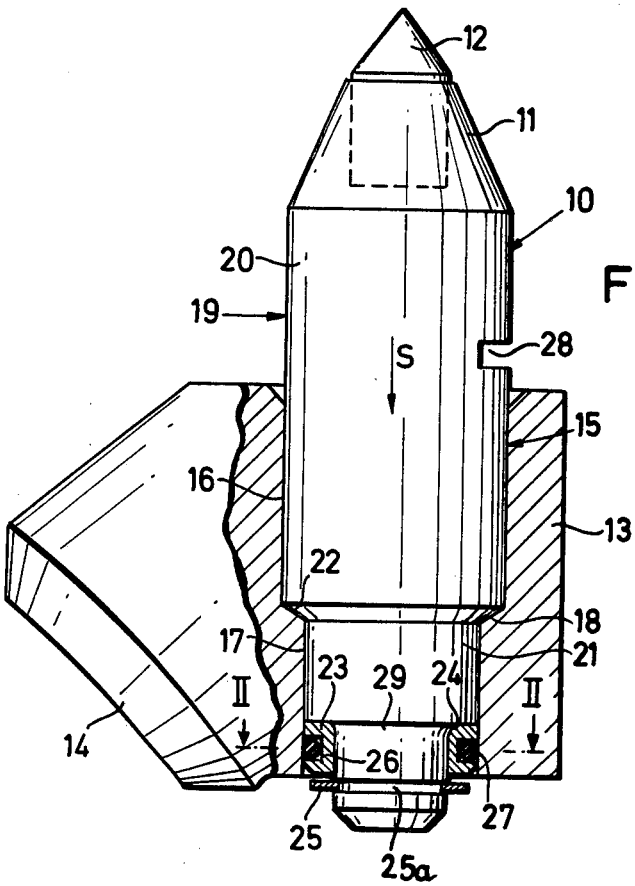
FIG. 1 is a part-sectional elevation of the first form of cutter bit assembly.

Referring to the drawings, FIG. 1 shows a cutter bit, indicated generally by the reference numeral 10, having a frusto-conical cutting head 11 which in known manner carries a hard metal tip 12 of conical formation. The cutter bit 10 is detachably held in a bit holder 13 which consists of a bearing block which is secured, for example, to a hewing cylinder 14, a hewing wheel or the like. The bit holder 13 is formed with a stepped cylindrical bore 15 which consists of a portion 16 of larger diameter and a portion 17 of smaller diameter, a tapered shoulder 18 being formed between the stepped portions 16 and 17 so as to form a support face for the cylindrical cutter bit shank 19 which is of stepped formation in conformity with the bore 15. The shank 19 thus consists of a shank portion 20 of larger diameter and a shank portion 21 of smaller diameter, a tapered support shoulder 22 being formed between the two portions 20 and 21. The shoulder 22, in use, bears axially against the support shoulder 18. The cutting head 11 is provided at the free end of the shank portion 20.

At its rear end the bit shank 19 has a cylindrical reduced diameter portion 29, the diameter of which is smaller than that of the shank portion 21. A metallic bearing ring 23 is rotatably mounted, with slight bearing play, on the shank portion 29 and bears laterally against an annular shoulder 24 formed between the shank portions 29 and 21. A circlip 25, sprung into a groove **25*a* of the shank portion 29, serves to secure the one-piece bearing ring 23 on the shank portion 29. The external diameter of the circlip 25 is smaller than the internal diameter of the portion 17 of smallest diameter of the stepped cylindrical bore 15**.

The bearing ring 23 has an external annular groove 26 which accomodates a compressible O-ring 27 made of yieldably elastic material such as synthetic plastics material or rubber.

The cutter bit 10 is inserted into its holder 13 by driving its shank 19, in the direction of the arrow S, into the stepped bore 15 of the bit holder. During this operation the O-ring 27 is so greatly elastically deformed in the narrowed portion 17 of the bore 15 that it bears with considerable friction on the cylindrical inner wall of this portion 17. The frictional force between the compressible O-ring and the bore portion 17 is so great that in use, the bit 10 is reliably secured in the bore 15 of the bit holder 13. In particular, the bit 10 cannot come out of the bore 15 in a direction opposed to the arrow S, even under the action of the centrifugal force of the rotating cutter cylinder or the like.

If the bit 10 needs replacing, a tool (not shown), for example a fork known per se for this purpose, is applied from the working side to the shank portion 20 protruding from the bore 15, to force the bit out of the bore. Since the bearing ring 23 and the circlip 25 each has an external diameter which is smaller than the internal diameter of the smaller stepped bore portion 17, the bit 10 can be pulled out of the bore 15 in a direction opposed to the arrow S, that it is towards the working side. Moreover, the bit 10 can be removed without first having to remove retaining and bearing parts such as the circlip 25. A recess indicated diagrammatically by the reference numeral 28 in FIG. 1, may be provided as an abutment for the bit-removing tool. This recess can also consist of an annular groove or an annular collar as known per se.

Figure 2:
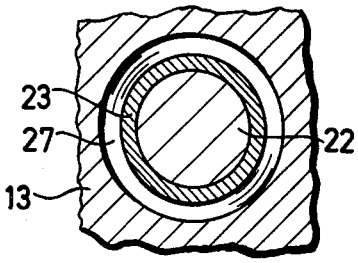
FIG. 2 is a cross-section taken on the line II—II of FIG. 1.
Figure 3:
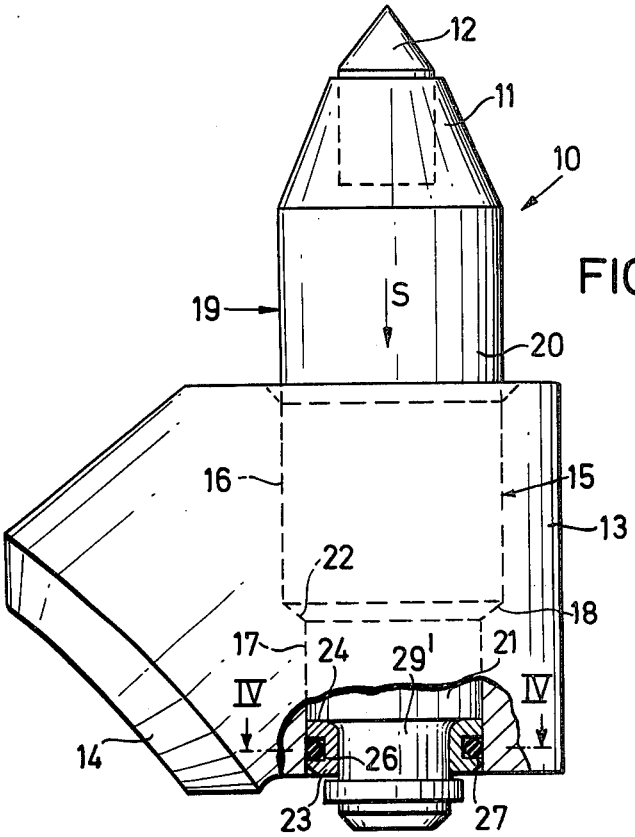
FIG. 3 is a part-sectional elevation of the second form of cutter bit assembly and FIG. 4 is a cross-section taken on the line IV—IV of FIG. 3.
Figure 4:
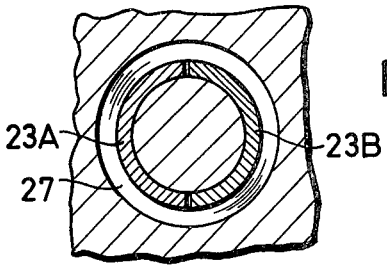

The cutter bit assembly shown in FIGS. 3 and 4 differs from that shown in FIGS. 1 and 2 and described above, merely in that the reduced-diameter portion of the cutter bit shank which receives the bearing ring 23 here consists of an annular groove 29' formed in the shank portion 21. So that the bearing ring 23 can be inserted into the annular groove 29', it is formed in two halves 23A and 23B (see FIG. 4). In all other respects the assembly of FIGS. 3 and 4 is identical to that of FIGS. 1 and 2 and accordingly like reference numerals have been used for like parts. Thus, with this form of assembly, it is again possible to insert the shank 19 of the bit 10, from the working side, in the direction of the arrow S into the bore 15 of the bit holder 13. Moreover, it can again be driven out in the opposite direction, without first having to detach and remove any components at the rear narrowed end of the bit shank 19.

It will be apparent that the yieldably elastic O-ring 27 can be so dimensioned and profiled that the resulting frictional force is adequate to secure the bit 10 reliably in the bore 15 of the bit holder 13. Moreover, any other sort of receiving ring could be used in place of the O-ring 27.

We claim:

1. In a cutter bit assembly for a cutting or winning machine, the cutter bit assembly comprising a cutter bit and a bit holder, the cutter bit having a generally cylindrical shank and a generally conical cutting head, the shank being rotatably received within a matched bore in the bit holder, the improvements comprising forming the shank with a reduced-diameter portion, rotatably mounting a bearing ring on said reduced-diameter portion, and seating a compressible locking ring within an annular groove formed in the outer cylindrical surface of the bearing ring, the locking ring extending radially outwardly of the outer cylindrical surface of the bearing ring and frictionally engaging the bore in the bit holder so as to restrain relative axial movement between the cutter bit and the holder.

2. A cutter bit according to claim 1, wherein an O-ring constitutes the locking ring.

3. A cutter bit according to claim 1, wherein the bearing ring is made of metal.

4. A cutter bit according to claim 1, wherein the locking ring is made of synthetic plastics material.

5. A cutter bit according to claim 1, wherein the locking ring is made of rubber.

6. A cutter bit according to claim 1, wherein the bearing ring is retained on said reduced-diameter portion of the shank by means of a securing element.

7. A cutter bit according to claim 6, wherein a circlip, which is received in a groove in said reduced-diameter portion of the shank, constitutes the securing element.

8. A cutter bit according to claim 1, wherein an annular groove in the shank constitutes said reduced-diameter portion.

9. A cutter bit according to claim 8, wherein the bearing ring is formed in two halves.

10. A cutter bit according to claim 1, wherein the shank is formed with a stepped portion between said reduced-diameter portion and the cutting head.

11. In a cutter bit assembly for a cutting or winning machine, the cutter bit assembly comprising a cutter bit and a bit holder, the cutter bit having a generally cylindrical shank and a generally conical cutting head, the shank being rotatably received within a matched bore in the bit holder, the improvements comprising forming the shank with a reduced-diameter portion, rotatably mounting a bearing ring on said reduced-diameter portion, and seating a compressible locking ring within an annular groove formed in the outer cylindrical surface of the bearing ring, the locking ring extending radially outwardly of the outer cylindrical surface of the bearing ring and frictionally engaging the bore in the bit holder so as to restrain relative axial movement between the cutter bit and the holder, wherein the bearing ring is retained on said reduced-diameter portion of the shank by means of a circlip which is received in a groove in said reduced-diameter portion of the shank, and wherein the external diameter of the circlip is less than the minimum internal diameter of the bore in the bit holder.

* * * * *